US008574039B1

(12) United States Patent
White et al.

(10) Patent No.: US 8,574,039 B1
(45) Date of Patent: Nov. 5, 2013

(54) BRUSH KIT FOR ABRASIVELY CONDITIONING CYLINDERS AND BORES IN MECHANICAL EQUIPMENT INCLUDING TRANSMISSIONS

(76) Inventors: Robert White, Tallahassee, FL (US); Jimmy Arledge, Havanna, FL (US); Russell Erickson, Tallahassee, FL (US); Dennis Erickson, Sr., St. Marks, FL (US)

( * ) Notice: Subject to any disclaimer, the term of this patent is extended or adjusted under 35 U.S.C. 154(b) by 913 days.

(21) Appl. No.: 12/458,701

(22) Filed: Jul. 21, 2009

Related U.S. Application Data

(60) Provisional application No. 61/202,982, filed on Apr. 24, 2009, provisional application No. 61/129,824, filed on Jul. 22, 2008.

(51) Int. Cl.
*B24D 11/00* (2006.01)

(52) U.S. Cl.
USPC ..... 451/527; 15/104.011; 451/51; 451/61; 451/541

(58) Field of Classification Search
USPC ..... 15/164, 104.11, 104.05, 104.2, 104.93, 15/163; 451/51, 61, 358, 526, 527, 541
See application file for complete search history.

(56) References Cited

U.S. PATENT DOCUMENTS

| | | | | |
|---|---|---|---|---|
| 3,384,915 | A * | 5/1968 | Rands | 15/179 |
| 3,871,139 | A * | 3/1975 | Rands | 451/466 |
| 5,269,104 | A * | 12/1993 | DiBiagio | 451/344 |
| 5,307,534 | A * | 5/1994 | Miller | 15/4 |
| 5,809,601 | A * | 9/1998 | Rivera | 15/23 |
| 6,165,281 | A * | 12/2000 | Yoon | 134/8 |
| 6,261,156 | B1 * | 7/2001 | Johnson et al. | 451/41 |
| 6,295,681 | B1 * | 10/2001 | Dolah | 15/22.1 |
| 7,124,882 | B1 * | 10/2006 | Jadydy | 206/234 |
| 7,823,235 | B2 * | 11/2010 | Parish | 7/158 |
| 2010/0216374 | A1 * | 8/2010 | Offer et al. | 451/28 |

* cited by examiner

*Primary Examiner* — Timothy V Eley

(57) ABSTRACT

A method and brush kit for cleaning and improving the roughness average of aluminum or aluminum coated valve cylinders and other open or blind bores in virtually any type of mechanical device by removing burrs and embedded particles within such cylinders and bores wherein the method provides a kit of a predetermined number of cylindrical brushes having metallic or nylon strands that are coated or impregnated with an aluminum oxide abrasive material. The method is particularly adapted for use by technicians in the automotive, marine, farm, aircraft and the like repair industries for treating transmission valve bores or cylinders and other open or blind bores and the like.

13 Claims, 2 Drawing Sheets

BRUSH KIT FOR ABRASIVELY CONDITIONING CYLINDERS AND BORES IN MECHANICAL EQUIPMENT INCLUDING TRANSMISSIONS

CROSS REFERENCE TO RELATED APPLICATIONS

This application claims the benefit of U.S. Provisional Applications Ser. No. 61/202,982, filed Apr. 24, 2009, and Ser. No. 61/129,824, file Jul. 22, 2008, in the name of the same inventors as the present application. The content of these provisional applications are incorporated herein, in their entirety, by reference.

BACKGROUND OF THE INVENTION

1. Field of the Invention

The present invention is generally directed to the field of marine, aircraft, automotive and hydraulic maintenance and repair and more particularly to the clearing and treating of open or blind, valve cylinders and the like, such as those in transmissions, and to a kit of cylindrical brushes that are treated with an aluminum oxide abrasive such that a brush selected from the kit may be safely used to de-burr or clean surface irregularities, remove embedded material build-up and polish the walls within a bore or cylinder.

2. Brief Description of the Related Art

Today's automotive and other transmissions are much different than earlier transmissions and use hydraulic valve bodies to control when a transmission is to shift and the overall timing of all the transmission components working together. Now, computers are used to control how the valve bodies are to function.

One of the biggest problems encountered to today's vehicle transmissions is fouling of valves within their valve cylinders caused by the use of hard coated aluminum valves running in cast aluminum valve bodies. The hardcoat on an aluminum valve is usually 0.002 to 0.003 inch in thickness. Typically, 50% of the hardcoat penetrates the aluminum leaving a 50% jacket or coating on the outside diameter of the valve. The aluminum valves tend to wear out prematurely. When a valve becomes worn, soft when the core is exposed, small particles of steel circulating in the transmission fluid, that have passed through the transmission filter, become embedded between the soft core of the valve and the valve body thereby causing the valve to hang up within the valve cylinder. When a valve hangs, it will normally cause a malfunction in the transmission which will cause a warning light on a vehicle instrument panel to illuminate and thereby worn a driver of the problem.

In addition to the foregoing, automatic vehicle transmissions typically have particulate trash circulating in the transmission fluid. Such trash is the by-product of friction and wear. Wearing of clutch plates, steel clutch plates and anywhere other components are in contact with one another will shed small particles into the transmission fluid as the transmission ages. Although filters catch a majority of the trash particles, some particles will bypass the filters and create build up on transmission parts. Due to tight tolerances between valves and the cylindrical bores in which they operate, typically a 0.0008 to 0.0015 inch clearance, these particles can cause a hanging of a valve or any other component that strokes inside a bore.

Valve cylinders may also be damaged during maintenance. In some instances, a valve may not easily come out of a valve cylinder or bore When a mechanic disassembles the valve body. In such instances, the mechanic may use a scribe that is a sharp pointed tool similar to a dentist pick. The mechanic may try to move the valve out by prying on it through the feed passages in the valve body. In most cases, the room to work is very limited with no good way to get leverage to pry the valve out. If the scribe slips, the pointed end can raise a burr on one of the passages perpendicular to the valve bore. The result will be a valve that is hard to put back in the valve body and will hang if the burr is not removed. Typically, the mechanic will place a piece of emery cloth around an end of a coat hanger or a slotted mandrill and use the cloth to rub or hone the inside of the bore. Such a honing process is time consuming and very difficult with the honing effect being different at the inner surfaces of the bore. In some instances, mechanics will use nylon bottle brushes that are coated with mineral spirits to clean a contaminated valve cylinder or bore. Unfortunately, such brushes are not effective to remove burrs or embedded trash from valve cylinders or bores.

Automotive transmissions are not the only mechanical components that include bores, either open or blind, that become damaged or coated during use and require cleaning and polishing to provide for optimum performance and extended life expectancy. Blind bore applications can be found in marine, farm, power mechanics of all ranges, lawn mowers and tractors, motorcycles, recreational vehicles, plumbing operations, air conditioning systems, air and space craft as well as other areas.

In view of the foregoing, there is a need to provide an abrasive tool or attachment that may be easily and quickly used to treat the inner surfaces of valve cylinders or bores in such a manner as to effectively remove burrs and other surface irregularities and to remove embedded materials that build up within the bores in such a manner that will not adversely effect the inner surfaces of the bores. In addition to the foregoing, due to the numerous diameters of valve cylinders or bores, there is a need to provide a manner in which substantially all valve bores in any mechanical field, including vehicle transmissions, may be treated with a minimum number of tools.

SUMMARY OF THE INVENTION

A method and kit assembly for cleaning and abrading the inner surfaces of valve cylinders or bores in order to remove surface irregularities, including burrs and embedded materials, and to improve the roughness average (Ra) of the bores by polishing so as to facilitate valve movement relative to a bore. The kit includes a plurality of bottle type cylindrical brushes having bristles that are treated with aluminum oxide such that the aluminum oxide is embedded with the material from which the bristles are made. The brushes are preferably retained within an enclosure such as a metal or plastic tool case or a plastic bag. The brushes of each kit are of different diameters with each having an elongated handle or shank portion and a head or bristle portion wherein the bristles are preferably arranged in a spiral relationship extending from center shafts of the brushes. The brushes have bristle diameters ranging from 0.250 inch to 2.000 inch with one preferred kit including brushes having diameters of 0.375, 0.500, 0.625 and 1.00 inch, respectively.

Using the methodology of the invention, a mechanic measures the diameter of the valve bore or cylinder in which a valve operates and thereafter selects a brush from a set of brushes which has a diameter that is closest in size to the measured diameter. In the preferred method, the mechanic selects the brush having a dimension that is the closest in size to the measured diameter but which is equal to or greater in diameter with respect thereto. The brush is thereafter inserted within the valve bore and manipulated to hone the interior walls of the valve bore.

It is a primary purpose of the invention to provide a method and kit for use by mechanics to facilitate and optimize the treating, cleaning and abrading of cylinder and other bores for valves and other structures to remove surface irregularities and embedded materials therefrom without adversely effective the operative characteristics of valves that are mounted to move within the bores.

It is also an object of the invention to provide a kit for use by mechanics to facilitate and optimize the treating, cleaning and abrading of cylinder and other mechanical open or blind bores for valves and other structures to remove surface irregularities and embedded materials therefrom without adversely effecting the operative characteristics of valves or other components mounted within the bores wherein the kit provides a minimum number of brushes that may be used for treating substantially all sizes of bores in use and thereby reduce the expenses of maintaining brushes and eliminating a need to have a brush for every diameter of mechanical bore.

It is yet another object of the present invention to provide a kit for use by vehicle mechanics and especially those working with vehicle transmission wherein the kit includes a minimum number of brushes that may be used for treating substantially all sizes of valve bores in use in convention automotive transmissions, and thereby reduce the expenses of maintaining brushes while eliminating a need to have a brush for every diameter of valve bore in transmissions.

BRIEF DESCRIPTION OF THE DRAWINGS

A better understanding of the invention will be had with reference to the accompanying drawing wherein.

DESCRIPTION OF THE PREFERRED EMBODIMENT

Figure 1:
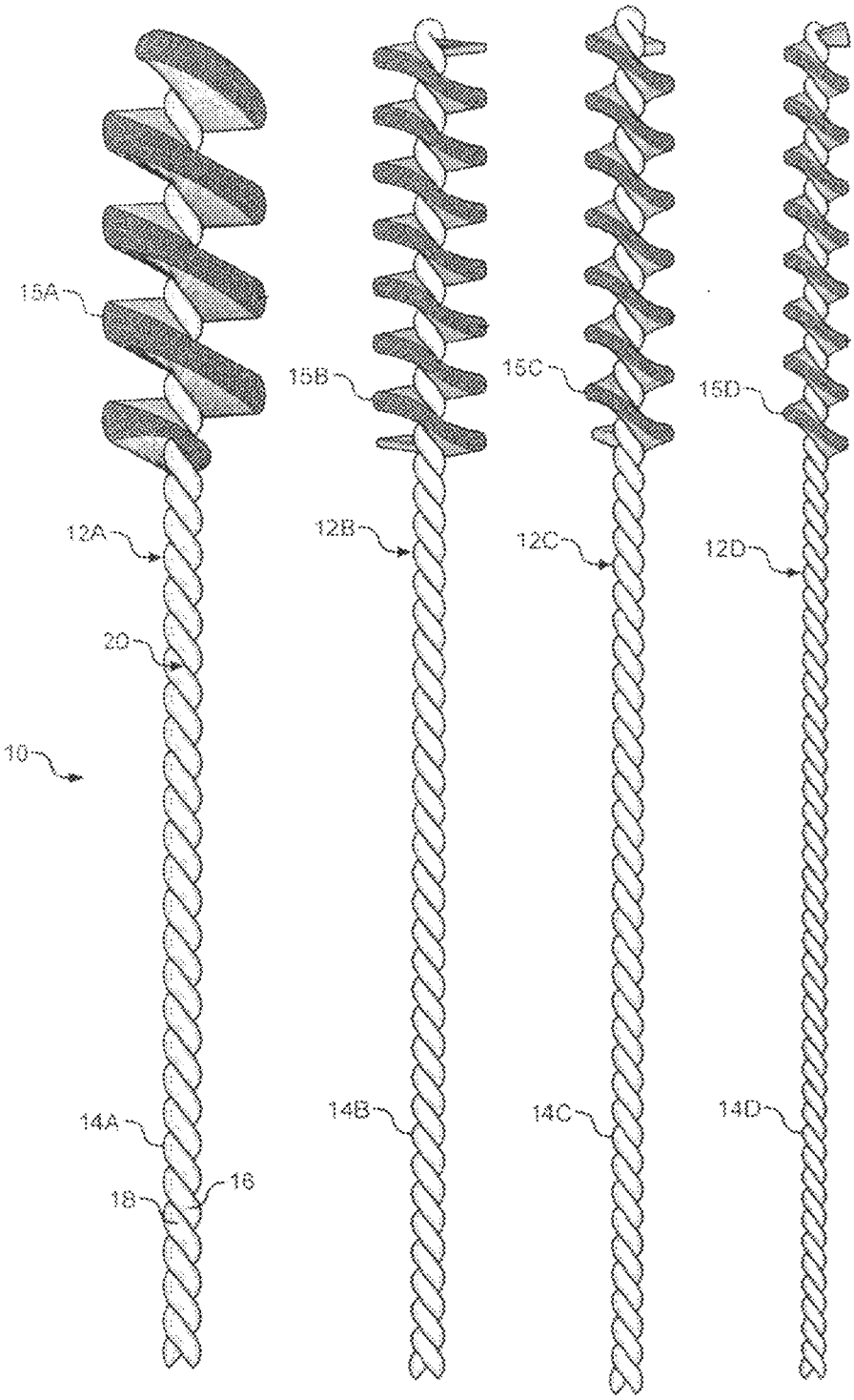
FIG. 1 is a front view of a set of four brushes in accordance with the teaching of the present invention.
Figure 2:
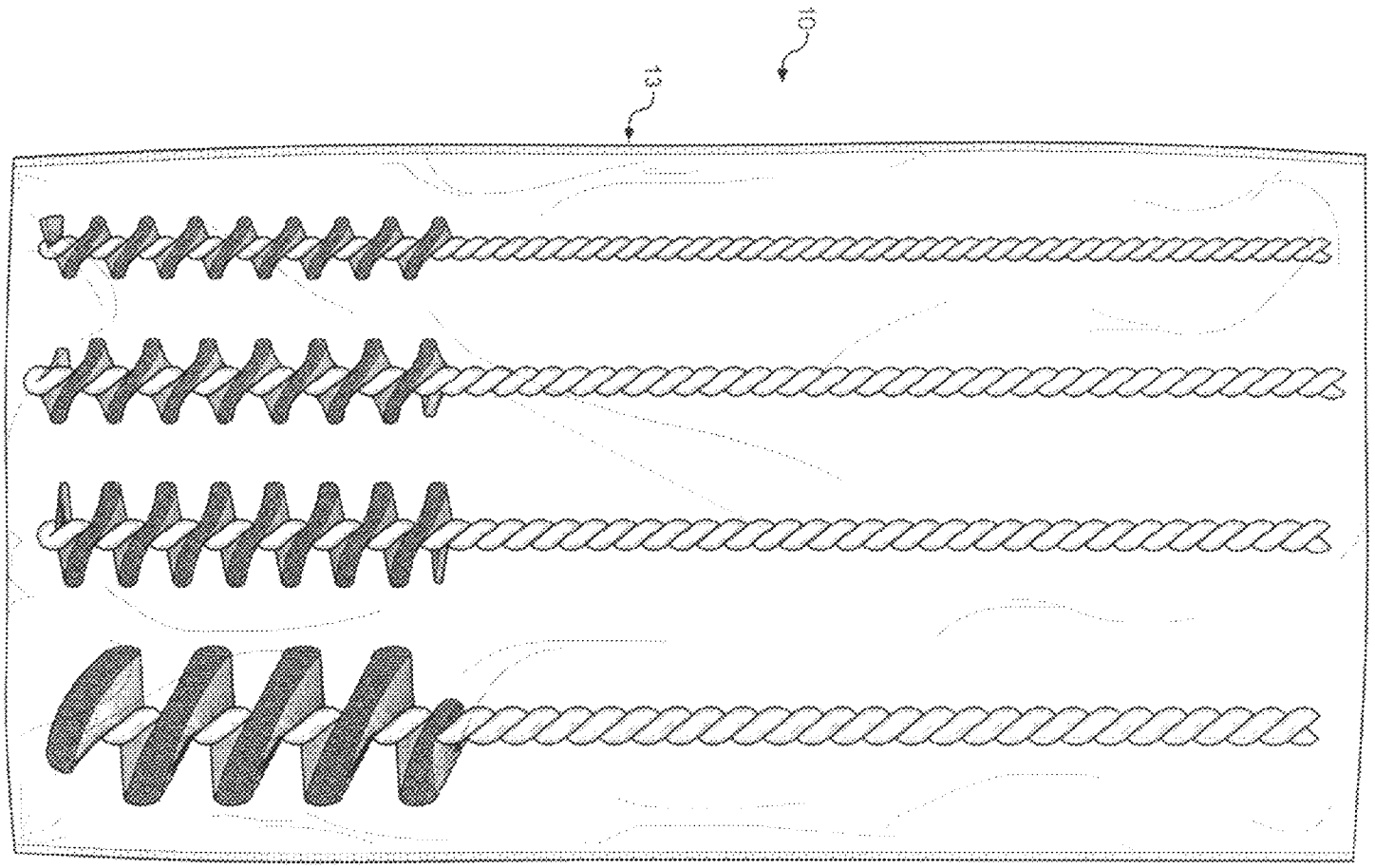
FIG. 2 is an illustrational view of the brushes within a tool container.

With reference to drawing FIGS. 1 and 2, a set 10 of four elongated cylindrical brushes 12A-12D are shown that may be retained in a tool or similar box or a plastic pouch 13. The brushes are particularly adapted for use in cleaning, de-burring, removing embedded material and for improving the surface roughness of valve cylinders or bores in vehicle transmissions and other similar bore structures. Each brush includes a stem or handle portion 14A-14D and a bristled head portion 15A-15D. The bristles 16 are preferably formed of metal strands or wires but, in some instances it may be possible to use some synthetic or plastic material, such as nylon, having aluminum oxide coated on and/or embedded within the material. The aluminum oxide is a preferred material for developing an abrasive surface along the bristles. The aluminum oxide on the bristles of the brushes is particularly well adapted to hone or polish the inner surfaces of valve cylinders or bores that are made of, or coated with, aluminum. The aluminum oxide may be of a grit size of 600 or less.

As shown, the bristles are mounted between a pair of twisted metal rods or thick stainless steel or other wires 16 and 18 that form a central shaft 20 of each brush such that they form a continuous spiral arrangement along the head portion of each brush. Each brush is approximately eight inches in length, however, the lengths may change depending upon the specific end use. Further, the brush lengths are generally in the range of 2.0 inches, but also may vary.

The valve bores of seven conventional transmissions were measured, with the number of bores totaling 143. The sizes of the bores ranged from 0.245 to 0.8025 inch. By way of example only, the valve measurements for an AXOD-E transmission were as follows:

Cond. Regulator Valve—0.590
Shift Solenoid Reg. Valve—0.3145
Main Pressure Regulator—0.3115
Converter Clutch Control—0.3565
1-2 Capacity MOD Valve—0.393
Accum. Regulator Valve—0.332
Back-out Valve—0.349
Pressure Failsafe—0.4325
2-3 Shift Valve—0.590
1-2 Shift Valve—0.590
Inter Clutch Shuttle Valve—0.3615
3-4 Shift Valve—0.590
Forward Clutch Control—0.378
Pull-in Control Valve—0.450
Neutral-DR Engagement Control—0.4325
2-3 Servo Regulator—0.349

Four sets of twelve brushes varying in diameter from 0.250 inch to 1.0 inch were tested on the various sizes of bores in an effort to determine which size of brush could be used safely to hone each bore so as to reduce the total number of brushes that would be necessary to maintenance all 143 bores in an effort to optimize the logistics and minimize the expense associated with a kit of a number of brushes to adequately perform the required honing maintenance. Although more than four brushes could be included within each kit 10, it was determined that a minimum number of brushes is four (4). It was also determined that the four brushes having brush diameter dimensions of 0.375, 0.500, 0.625 and 1.00 inch are necessary.

It was also discovered that the use of the brushes not only removed embedded material and burrs, but that the surface roughness average (Ra) of the bores was significantly improved. Typically a used valve body bore will yield a Ra of 27 to 32. After just five reciprocating motions of a brush within bore yielded bore Ra values of 15 to 21. The lower the Ra value, the smoother the finish. After fifty cycles with a brush, the Ra value was measured at Ra 12.

The kits of the invention permit a mechanic to include in their tool sets a minimum number of brushes that can be safely used to hone and clean all the valve cylinders or bores within conventional automotive transmissions or other mechanical components. The kits thus minimize tool components, reduces costs to the mechanic and make inventory control easy. In use, the mechanic measures the diameter of the valve bore to be treated by honing with one of the brushes of the kit. The mechanic then selects the brush 12A-12D that is adapted to be safely hone the size of bore that has been measured. Thereafter, the stem of the brush is inserted into a cordless, electric, hydraulic or pneumatic powered drill and the bristle head end is inserted within the bore. The drill is activated to spin the brush keeping the rate below 3000 rpm. The brush is work in and out of the bore until the bore is polished so that the valve is free from sticking. After honing or polishing, the bore should be cleaned by blowing out with an air hose. Solvents may be used for additional cleaning.

The following brush sizes are recommended for valve bores of conventional transmissions:

Brush Size 1.0"
Bore Size 1.0 to 0.750"
Brush Size ⅝"

Bore Size 0.625 to 0.500"
Brush Size ½"
Bore Size 0.500 to 0.375"
Bore Size ⅜"
Bore Size 0.375 to 0.250"

As noted herein, the product kits of the invention are not limited to the automotive industry and may be adapted for use by mechanics in other mechanical fields as set forth above. In view of the foregoing, other brush sizes have been created including brush diameters of 0.250, 0.312, 0.437, 0.562, 0.687, 0.750, 0.812, and 0.875 inch, respectively. Typically, such brushes will have bristle lengths up to 2.0 inch and shafts of up to 8.0 inches such that cylinders or bores from diameters of 0.200 to 2.0 inches and depths to 7.5 inches may be cleaned and polished.

Although the brushes have been described with respect to use with aluminum or aluminum coated components, the brushes may be used or cast iron, steel, and sintered metal components including magnesium.

The brushes of the invention further constitute "green" products as they allow parts and components that would normally be scraped, to be cleaned for extended periods of use and thus reduce material waste and disposing of components.

Areas of use of the brushes include valve body bores, accumulator bores, servo bores, thread holes, drum surfaces, pump bore holes, valve guide tubes, spark plug seal tubes and thread holes, valve trains, rockers and rollers, cam shaft bores, crank and rod bores, thermostat housings, throttle bodies and blind holes in intake manifolds, oil pump pick up tubes, oil galleries, valve cover gasket debris removal, EGR tubes and vacuum ports and the like.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

We claim:

1. A kit for polishing bores and cylinders in mechanical devices comprising; a container housing defining an enclosure, a plurality of cylindrical brushes removably carried within the container housing, each brush including a bristle head portion of a substantially uniform diameter formed of bristles coated and/or embedded with an abrasive aluminum oxide material and a diameter of each brush differing from a diameter of each of the other of the plurality of brushes, each bristle head portion being effective for use to polish bores having diameters within a predetermined range of diameters and each of the brushes having a bristle free stem.

2. The kit of claim 1 wherein each brush has a bristle head portion diameter in a size within a range of 0.250 inch to 2.0 inches.

3. The kit of claim 2 including four brushes wherein the brushes have bristle head portion diameters of 0.375 inch, 0.500 inch, 0.625 inch and 1.00 inch, respectively.

4. The kit of claim 3 wherein the bristle head portions have a length not exceeding 2.0 inches.

5. The kit of claim 4 wherein the bristle free stems have a length not exceeding 8.0 inches.

6. The kit of claim 5 wherein the bristles are formed of material selected from a group of materials consisting of a metal and a plastic.

7. The kit of claim 1 wherein the bristles are spirally arranged.

8. A kit for polishing aluminum valve bores of a vehicle transmission comprising; a container housing defining an enclosure, a plurality of cylindrical brushes removably carried within the container housing, each brush including a bristle head portion of a substantially uniform diameter formed of bristles coated and/or embedded with an abrasive aluminum oxide material and being of a diameter that differs from each of the other of the plurality of brushes, each bristle head portion being effective for use to polish bores having diameters within a predetermined range of diameters and each of the brushes having a bristle free stem.

9. The kit of claim 8 wherein each brush has a bristle head portion has a diameter in a size within a range of from 0.250 inch to 2.0 inches.

10. The kit of claim 8 including four brushes wherein the brushes have bristle head portion diameters of 0.375 inch, 0.500 inch, 0.625 inch and 1.00 inch, respectively.

11. The kit of claim 10 wherein the bristle head portions do not exceed 2.0 inches in length.

12. The kit of claim 11 wherein the bristle free stems have a length not exceeding 8.0 inches.

13. The kit of claim 8 wherein the bristles are spirally arranged.

* * * * *